US009936832B2

(12) United States Patent
McBroom et al.

(10) Patent No.: US 9,936,832 B2
(45) Date of Patent: Apr. 10, 2018

(54) DRESSING AID DEVICE

(71) Applicants: Robert Lee McBroom, North Kingston, RI (US); Edward Thomas Gervais, Cranston, RI (US)

(72) Inventors: Robert Lee McBroom, North Kingston, RI (US); Edward Thomas Gervais, Cranston, RI (US)

( * ) Notice: Subject to any disclaimer, the term of this patent is extended or adjusted under 35 U.S.C. 154(b) by 0 days.

(21) Appl. No.: 15/036,694

(22) PCT Filed: Nov. 14, 2014

(86) PCT No.: PCT/US2014/065762
§ 371 (c)(1),
(2) Date: May 13, 2016

(87) PCT Pub. No.: WO2015/073862
PCT Pub. Date: May 21, 2015

(65) Prior Publication Data

US 2016/0286997 A1 Oct. 6, 2016

Related U.S. Application Data

(60) Provisional application No. 61/904,920, filed on Nov. 15, 2013.

(51) Int. Cl.
*A47G 25/90* (2006.01)
*A41D 1/06* (2006.01)

(52) U.S. Cl.
CPC ..... *A47G 25/90* (2013.01); *A41D 1/06* (2013.01)

(58) Field of Classification Search
CPC .... A47G 25/90; A47G 25/901–25/908; A41D 1/06
(Continued)

(56) References Cited

U.S. PATENT DOCUMENTS 3,692,217 A * 9/1972 Smith ..... A47G 25/905 223/111
4,130,226 A * 12/1978 Farrell ..... A47G 25/905 223/111
(Continued)

FOREIGN PATENT DOCUMENTS

DE 202010010104 11/2010
JP 3090910 1/2003
(Continued)

OTHER PUBLICATIONS

International Search Report and Written Opinion dated Feb. 4, 2015 issued in PCT Patent Application No. PCT/US2014/065762, 10 pages.
(Continued)

*Primary Examiner* — Ismael Izaguirre
(74) *Attorney, Agent, or Firm* — Grossman Tucker Perreault & Pfleger PLLC

(57) ABSTRACT

A dressing aid device comprising a shaft, and a pants supporting head portion coupled to a distal end region of said shaft, wherein the pants supporting head portion is configured to support pants along a waistline portion of the pants and provide an arcuate waistline opening, wherein the arcuate waistline opening is sized and shaped to allow a user to advance at least one leg through the arcuate waistline opening.

23 Claims, 6 Drawing Sheets

(58) Field of Classification Search
USPC ..... D6/326–328
See application file for complete search history.

(56) References Cited

U.S. PATENT DOCUMENTS

| | | | | |
|---|---|---|---|---|
| 6,276,578 | B1 * | 8/2001 | Stenger | A47G 25/905 223/111 |
| 6,942,129 | B2 * | 9/2005 | Ferraioli | A47G 25/908 223/113 |
| 8,528,796 | B1 * | 9/2013 | Bosko | A47G 25/905 223/111 |
| 2002/0139819 | A1 | 10/2002 | Ferraioli | |
| 2007/0095866 | A1 * | 5/2007 | Zumbach | A47G 25/905 223/111 |
| 2010/0078450 | A1 | 4/2010 | Longhurst | |
| 2010/0193554 | A1 * | 8/2010 | Atkinson | A47G 25/90 223/111 |
| 2013/0214016 | A1 | 8/2013 | Carbray | |
| 2013/0270310 | A1 | 10/2013 | Santos | |

FOREIGN PATENT DOCUMENTS

| | | |
|---|---|---|
| JP | 2004105292 | 4/2004 |
| JP | 2007029239 | 2/2007 |
| WO | 2007105003 | 9/2007 |

OTHER PUBLICATIONS

International Preliminary Report on Patentability dated May 26, 2016 issued in PCT Patent Application No. PCT/US2014/065762, 8 pages.

* cited by examiner

DRESSING AID DEVICE

FIELD OF THE INVENTION

The present disclosure relates to a dressing aid device, and more particularly a personal dressing aid device to assist an individual person in putting on their pants.

BACKGROUND

Individuals subjected to certain medical procedures, or afflicted with certain medical conditions, may have difficulty getting dressed with certain garments, particularly their pants.

Many individuals are able to pull on their pants from a standing position by inserting one of their legs through a first pant leg; and then inserting their other leg through a second pant leg; and thereafter bending to grasp the pants, and subsequently standing to pull the pants up over the legs and hips.

However, for individuals who may not be able to pull on their pants from a standing position, and are confined to a seated position, putting on pants may become much more difficult.

For example, individuals who have recently had hip surgery may not be able to place weight on the hip of surgical repair for a period of time, and thus are not able to put on their pants from a standing position. Thus, to make putting their pants on more difficult, such individuals must ordinarily put their pants on from a seated position, typically while seated on a bed or a chair, such as a wheel chair. Furthermore, such becomes even more difficult when such individuals are not able to significantly bend their knees from such a seated position, due to precautions arising from the surgery, as to bring their feet and the pants within an arm's length for placing their feet within a waist opening of the pants.

Currently, in order to aid such individuals, they may be provided with grasping extension arms which are hand operable. The grasping arms are often provided with a trigger type operation mechanism which enables a distal end grasper to open and close. However, when an attempt is made to use the graspers bilaterally, i.e. with both the left and right arms, the graspers become difficult to coordinate.

Furthermore, after hip surgery, an individual may be instructed to sit at such an angle that more of their body weight is placed on the side of their pelvis which did not have the surgery. As a result of sitting at such a tilted angle, it may be understood that such individuals are not afforded a level seating platform for good core/trunk control and may easily tip towards the side of the pelvis having the surgery. Consequently, such individuals will often stabilize their position by using the arm opposite the side of surgical repair as a brace against tipping towards the side of the pelvis which has undergone surgery. However, it is not possible for such individuals operating bilateral grasping devices to adequately brace themselves to provide core support.

The foregoing difficulties may also be encountered by individuals who are physically challenged, particularly as a result of an accident or medical condition, and may not have the ability to stand upright while putting their pants on and must be seated to accomplish such.

What is needed is a personal dressing aid device which will help seated individuals put on their pants in light of the foregoing difficulties.

SUMMARY

The present disclosure provides a personal dressing aid device which enables users of the device to pull their pants up over their thighs from a seated position with use of one of the upper extremities, i.e. unilateral dressing. In such a manner, a user of the dressing aid device may stabilize their seated position with their other upper extremity while operating the dressing aid device, and not be subjected to falling over or otherwise losing their balance with use of the device.

In one embodiment, the present disclosure provides a dressing aid device comprising a shaft, and a pants supporting head portion coupled to a distal end region of said shaft, wherein the pants supporting head portion is configured to support pants along a waistline portion of the pants and provide an arcuate waistline opening, wherein the arcuate waistline opening is sized and shaped to allow a user to advance at least one leg through the arcuate waistline opening.

FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
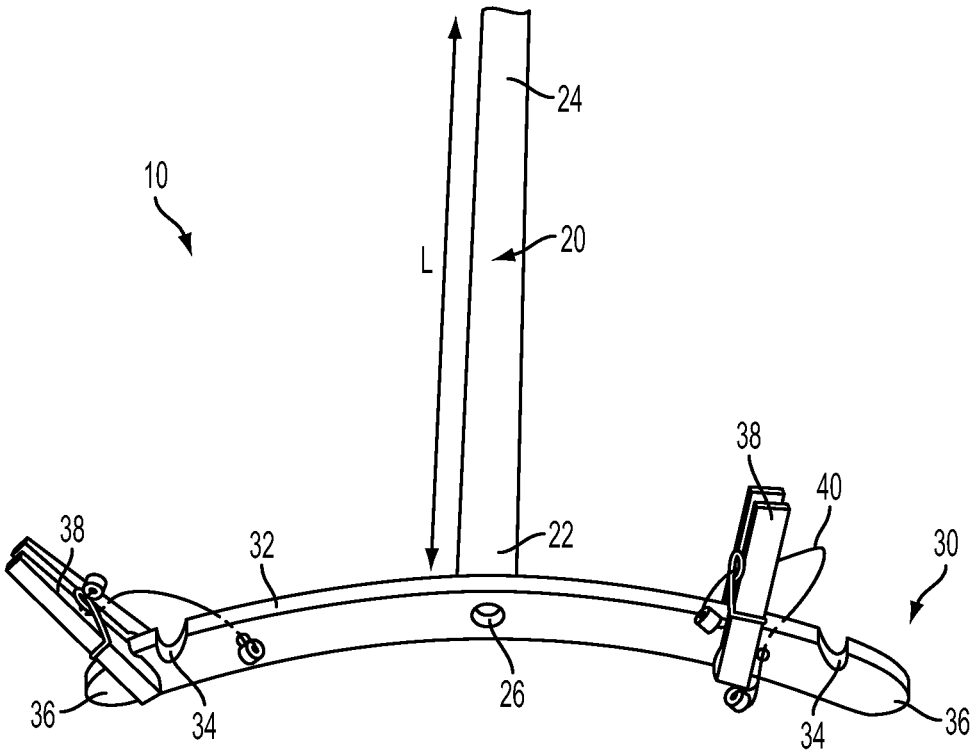
FIG. 1 is a perspective view of a dressing aid device according to a one embodiment of the present disclosure.

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

Referring now to FIG. 1, there is shown an embodiment of a dressing aid device 10 according to the present disclosure. Dressing aid device 10 comprises a rigid cylindrical shaft 20 and a rigid pants supporting head portion 30, with the pants supporting head portion 30 coupled to a distal end region 22 of said shaft 20, particularly the distal end of the shaft 20.

Shaft 20 may have a diameter in a range of 0.25 inch to 1 inch (6.35 mm to 25.4 mm), and more particularly in a range of 0.5 inch to 0.875 inch (12.7 mm to 22.2 mm). In the present embodiment, shaft 20 may have a diameter of 0.75 inch (19 mm). Shaft 20 may have a longitudinal length in a range of 15 inches to 40 inches (381 mm to 1016 mm), and may be telescopic in a known manner.

Shaft 20 and pants supporting head portion 30 may be configured not to undergo any significant deformation (bending) during use of the dressing aid device 10 for its intended purpose. Shaft 20 and pants supporting head portion 30 may be made of at least one of wood, metal and plastic.

Pants supporting head portion 30 is arranged transverse to a longitudinal axis L of the shaft 20, and more particularly substantially perpendicular (within 10 degrees of being perpendicular) to the longitudinal axis L of the shaft 20. As shown, the pants supporting head portion 30 is arranged perpendicular to the longitudinal axis L of the shaft 20.

The pants supporting head portion 30 may be mechanically fastened to the shaft 20 with a mechanical fastener 26, in the form of a screw, which bisects the pants supporting head portion 30, which has an arch shape, into half portions extending transversely from the shaft 20. Stated another way, the pants supporting head portion 30 is fastened to the shaft 20 at the middle or top of the arch shape of the pants supporting head portion 30. A proximal end region 24 of the shaft 20 provides a handle to manually (by hand) orientate the pants supporting head portion 30.

Figure 2A:
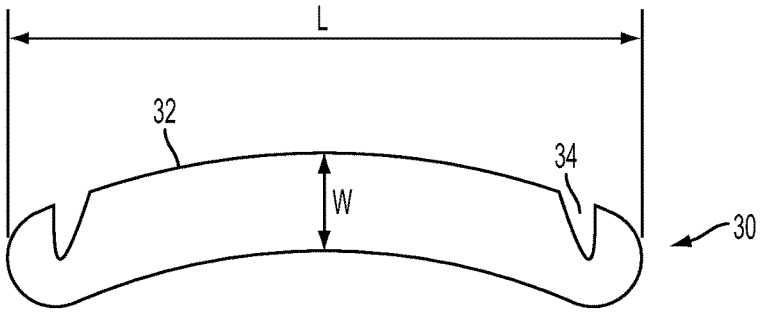
FIG. 2 is an end view of various pants supporting head portions of the dressing aid device of FIG. 1.
Figure 2B:
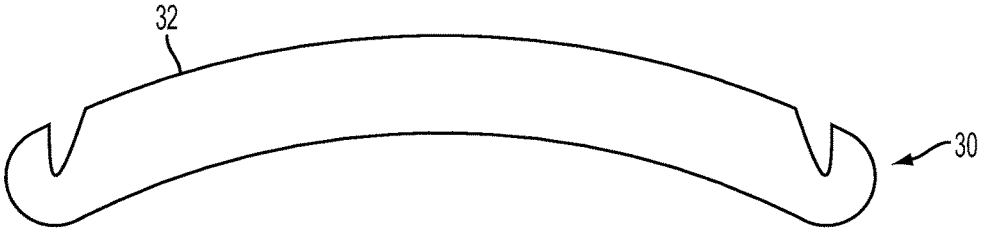
Figure 2C:
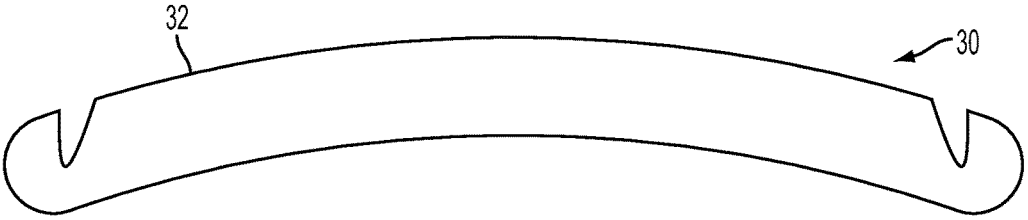

As best shown by FIG. 2, the pants supporting head portion 30 has an upper arcuate surface 32 which may be used to support pants thereon. As shown by FIG. 2, depending on the size of the user of the dressing aid device 10, the pants supporting head portion 30 may have different sizes. As shown by FIG. 2*a*, the pants supporting head portion 30 has a length of 7.25 inches (184.1 mm), and the arcuate surface 32 is at least partially defined by a radius of at least 12 inches (304.8 mm). As shown by FIG. 2*b*, the pants supporting head portion 30 has a length of 10 inches (254 mm), and the arcuate surface 32 is at least partially defined by a radius of at least 16 inches (406.4 mm). As shown by FIG. 2*c*, the pants supporting head portion 30 has a length of 12 inches (304.8 mm), and the arcuate surface 32 is at least partially defined by a radius of at least 18 inches (457.2 mm). Thus, it should be understood that the length of the pants supporting head portion 30 may be in a range from 7.25 inches to 12 inches (181.1 mm to 304.8 mm), and the arcuate surface 32 is at least partially defined by a radius in a range of 12 inches to 18 inches (304.8 mm to 457.2 mm).

Figure 3:
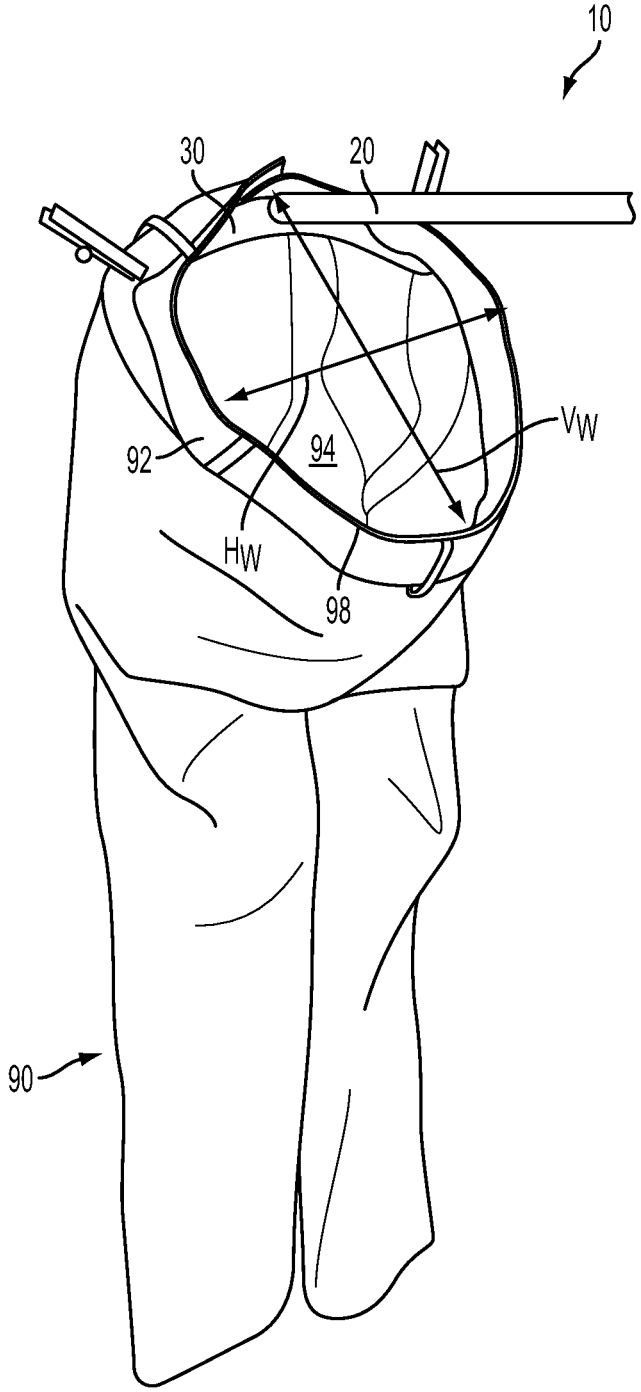
FIG. 3 is a perspective view of the dressing aid device of FIG. 1 being used to support pants.
Figure 4:
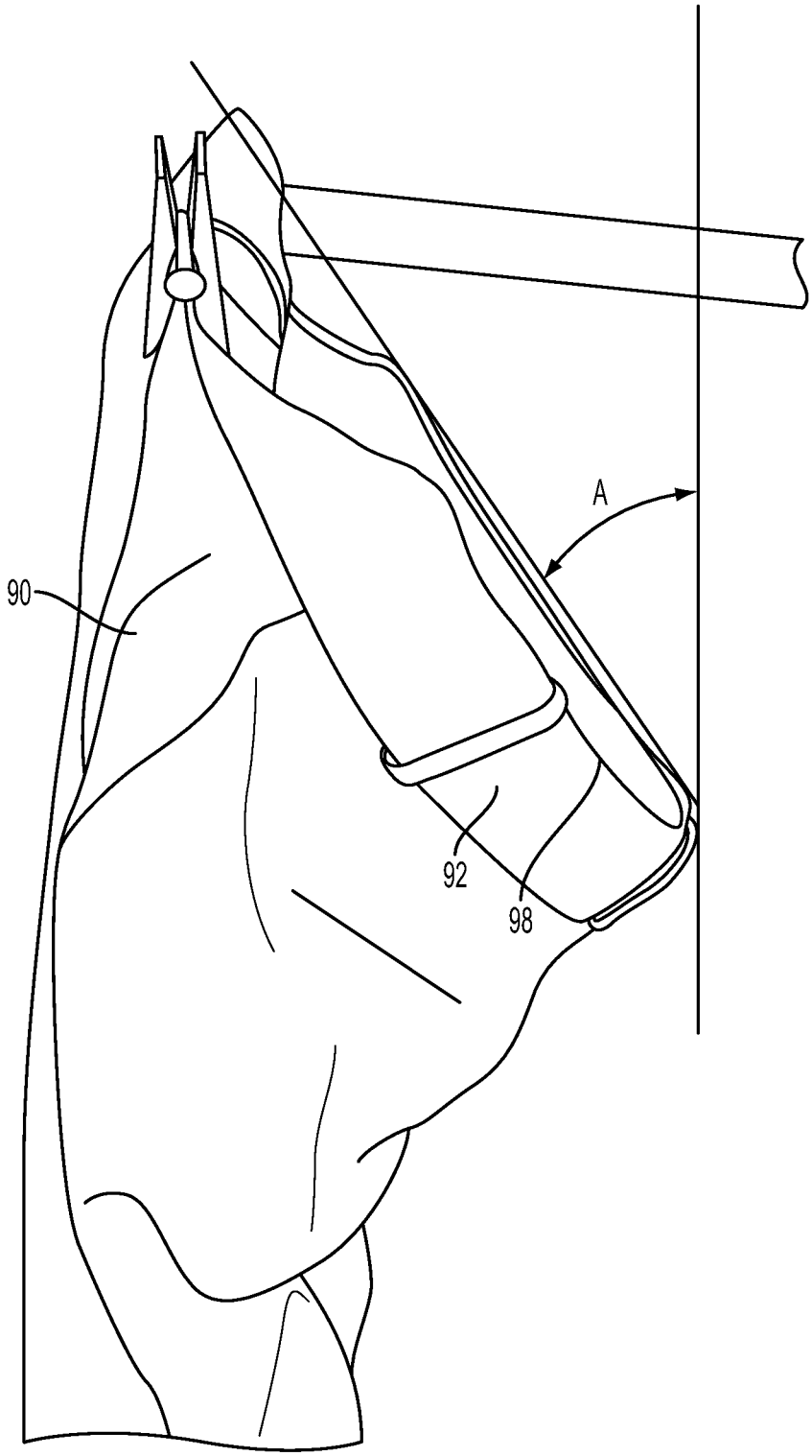
FIG. 4 is a side view of the dressing aid device of FIG. 1 being used to support pants.

As shown in FIGS. 3 and 4, the pants supporting head portion 30 is configured to support pants 90 along a waistline portion 92 of the pants 90 and provide an arcuate target (waistline) opening 94, wherein the arcuate waistline opening 94 provides a sized and shaped target to allow a user to advance at least one leg through the arcuate waistline opening 94.

More particularly, the pants supporting head portion 30 is further configured to provide an arcuate waistline opening 94 under a force of gravity. As shown, the arcuate waistline opening 94 may be substantially circular and substantially vertical, depending on the drape of the pants 90. As shown by FIGS. 3 and 4, the shaft 20 and the pants supporting head portion 30 is arranged such that the arcuate waistline opening 94 is substantially circular and substantially vertical when a longitudinal length L of the shaft 20 is substantially horizontal (within 10 degrees of being horizontal).

As used herein, the arcuate waistline opening 94 may be considered substantially circular if a horizontal width $H_W$ of the arcuate waistline opening 94 is in a range of 65% to 140% of the vertical width $V_W$ of the arcuate waistline opening 94. As used herein, the arcuate waistline opening 94 may be considered substantially vertical if the arcuate waistline opening 94 is at angle A which makes the waistline opening 94 arranged more towards a vertical orientation than a horizontal orientation, such as with an angle A being within 40 degrees of being vertical, such as in a range from 0 degrees to 40 degrees. In other embodiments, depending on the drape of the pants 90, the arcuate waistline opening 94 may have different shapes.

As shown, the pants supporting head portion 30 may be particularly configured to support pants 90 along an upper arcuate surface 32. More particularly, the arcuate surface 32 is shown to be semi-circular, and arch shaped.

Figure 5:
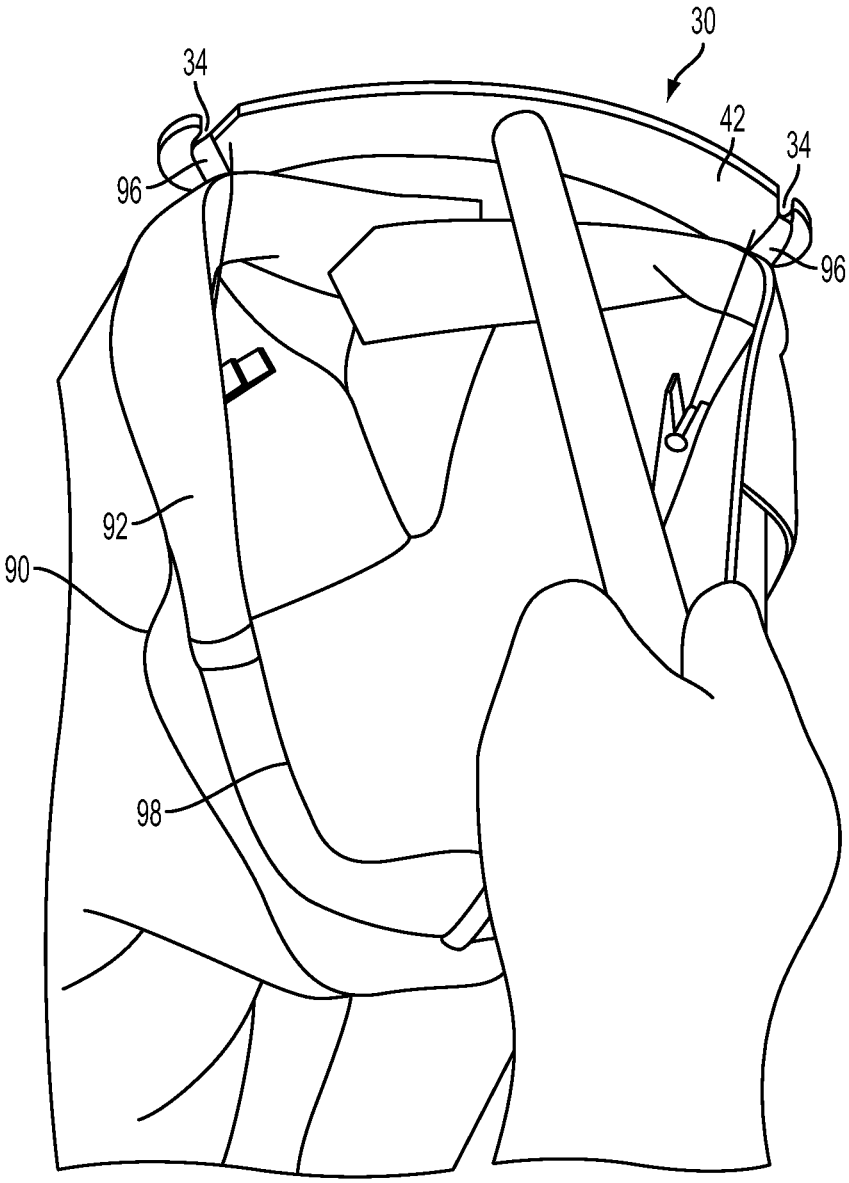
FIG. 5 is a close-up view of the dressing aid device of FIG. 1 being used to support pants with the belt loops of the pants.

As best shown by FIG. 5, the pants supporting head portion 30 is also configured to support pants 90 by engaging with belt loops 96, and more particularly may be configured to fit within belt loops 96 of the pants 90. As such, the pants supporting head portion 30 may particularly be planar (like a belt), particularly with a maximum thickness of up to and including 0.5 inches (12.7 mm), and more particularly, a maximum thickness of up to and including 0.25 inches (6.35 mm). Furthermore, with regards to width, the pants supporting head portion 30 may have a maximum width up to an including 1.25 inches (31.75 mm), and more particularly a maximum width up to an including 1 inch (25.4 mm).

Furthermore, as shown in FIG. 5, the pants supporting head portion 30 is configured to support pants 90 with at least one pants retaining notch 34 at opposing end regions 36 of the pants supporting head portion 30 to hook the belt loops 96 of the pants 90.

Returning briefly to FIG. 1, in addition to the foregoing, dressing aid device 10 comprises at least one clamping mechanism 38 to clamp the pants 90 to the dressing aid device 10, and particularly to clamp the pants 90 to the pants supporting head portion 30. As shown, the dressing aid device 10 comprises a pair of clamping mechanisms 38 coupled to the pants supporting head portion 30 with connecting line 40 which forms part of the pants supporting head portion 30.

In one embodiment of using dressing aid device 10, a waistline portion 92 of pants 90 may be first placed over the pants supporting head portion 30 by the user of the dressing aid device 10 while using their upper extremities (hands). More particularly, a length of the waistline portion 92 of pants 90 may be draped over arcuate surface 32 of the pants supporting head portion 30 such that the pants straddle the width of the pants supporting head portion 30, with a perimeter edge 98 of the pants 90 being located on one longitudinal side 42 of the pants supporting head portion 30 and the remainder of the pants 90 being located on the opposing longitudinal side 44 of the pants supporting head portion 30. The user of the dressing aid device 10 may then use clamping mechanisms 38 to clamp the pants 90 to pants supporting head portion 30.

As such, referring to FIGS. 3 and 4, when the pants 90 are placed onto the pants supporting head portion 30 in such fashion, and the shaft 20 of the dressing aid device 10 is held substantially horizontal, the pants supporting head portion 30 supports pants 90 along a waistline portion 92 of the pants 90 such that, under a force of gravity, an arcuate waistline opening 94 is formed in pants 90, wherein the arcuate waistline opening 94 is sized and shaped to allow a user to advance at least one leg through the arcuate target waistline opening 94.

More particularly, the pants supporting head portion 30 supports pants 90 along a waistline portion 92 of the pants 90 such that an arcuate waistline opening 94 is formed in pants 90 which is substantially circular and substantially vertical.

Thereafter, the user of dressing aid device 10 may grasp the proximal end region 24 of shaft 20 and advance the dressing aid device 10, and particularly the pants supporting head portion 30, distally towards their feet with one of their upper extremities while maintaining their core balance with the other upper extremity.

Once the pants supporting head portion 30 and the arcuate waistline opening 94 are in s suitable position, generally to one side of the feet or above the feet of the user, the user of dressing aid device 10 may lift and slightly contract (bend) one or both legs from a seated position, insert the leg(s) into the arcuate waistline opening 94 and thereafter extend the leg(s) to advance the leg(s) through the arcuate waistline opening 94 and into the pants. At the same time, or some time thereafter, the user of dressing aid device 10 may retract the dressing aid device away from their feet and towards their torso with one extremity, at an angle substantially parallel with the legs (within 20 degrees) which results in pulling the pants 90 up and over the lower leg(s) (the calf of the leg(s)) and subsequently over at least a portion of the upper leg(s) (the thigh of the leg(s)). Thereafter, the user of dressing aid device 10 may disengage pants 90 from device 10 with their upper extremities, and continue to advance their pants 90 manually (by hand) over their hips.

In various methods, it should be understood that the user of dressing aid device 10 does not necessarily have to bend their legs to insert them into the arcuate waistline opening 94. In such case, the user may simply advance the dressing aid device 10, and particularly the pants supporting head portion 30, distally until the arcuate waistline opening 94 is past the feet, and then simply raise one or both legs from a seated position and insert the leg(s) into the arcuate waistline opening 94. The user may then retract the dressing aid device away from their feet, which results in pulling the pants 90 up as disclosed above. It should also be understood that the user of device 10 does not necessarily have to use the dressing aid device 10 to pull pants 90 over the upper leg(s). In other words, the user of dressing aid device 10 only needs to pull the pants 90 upwards over their leg(s) a sufficient distance in order to comfortably grasp the pants 90 with one of their upper extremities. At that time, the user of dressing aid device 10 may separate the pants 90 from the dressing aid device 10 and continue to pull their pants 90 up manually using their upper extremities.

In another embodiment of using dressing aid device 10, as shown in FIG. 5, the pants supporting head portion 30 may be merely placed within the confines of belt loops 96 to adequately secure the pants 90 to the pants supporting head portion 30. In other words, the clamping mechanisms 38 may not be required. Furthermore, to further ensure the pants 90 will not separate from pants supporting head portion 30, the position of the pants relative to supporting head portion 30 may be maintained within the belt loops 96 by virtue of the belt loops 96 entering the belt loops entering pants retaining notches 34 and being held therein. Such inhibits the pants supporting head portion 30 from disengaging from the belt loops 96.

Figure 6:
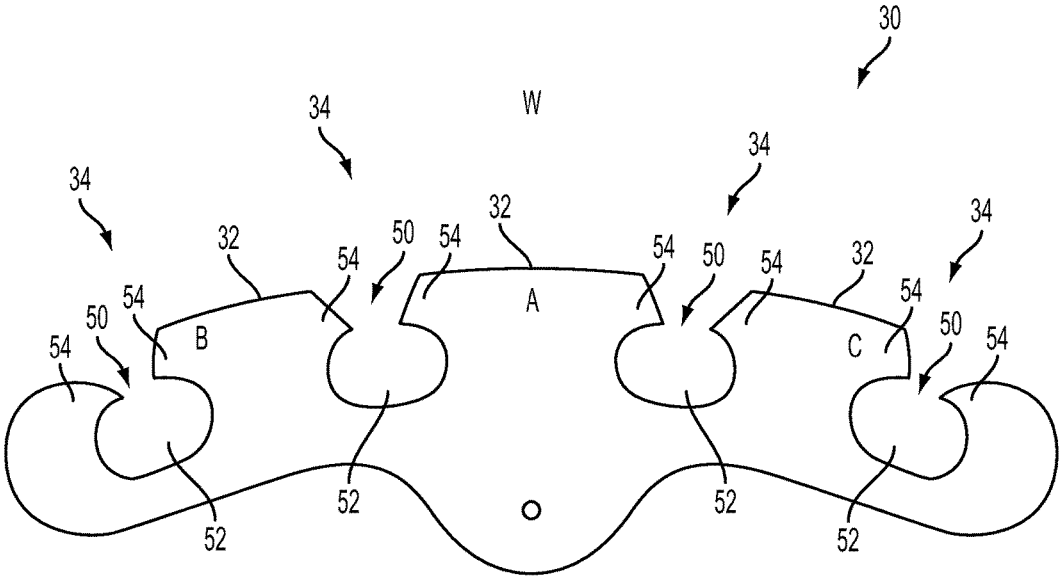
FIG. 6 is an end view of a pants supporting head portion according to another embodiment of the present disclosure.

In another embodiment of the dressing aid device 10, as shown in FIG. 6, the clamping mechanism 38 has been eliminated from the pants supporting head portion 30. Furthermore, pants retaining notch 34 now comprises a narrow (tapering) entrance portion 50 which leads into a widened (enlarged) retention portion 52, with the widened retention portion 52 having a width wider than the narrowest width of the narrowing entrance portion 50. As a result, opposing undercut lips/edges 54 are created at the interface between the narrow entrance portion 50 and the widened retention portion 52.

While the narrow entrance portion 50 is shown to taper with a V-shape, i.e. tapers from both sides of the entrance portion 50, the entrance portion 50 may only taper from one side of the entrance portion 50, or may not taper at all and have a constant width which is narrower than the widened retention portion 52. Also, while the widened retention portion 52 is shown has having an oval shape, the widened retention portion 52 may also comprise other shapes such as being spherical (circular) and rectangular.

With the design of FIG. 6, the pants 90 may be inserted (woven) through the pants retaining notches 34 and retained therein without the clamping mechanism 38. The center line of the pants 90 may be first placed on the pants supporting head portion 30 at location A, and the waistline portion 92 of the pants 90 may then be inserted into pants retaining notches 34 by moving outwards towards locations B and C. In order to retain the pants 90 in the pants retaining notches 34, a length of the waistline portion 92 may be grasped and compressed by hand and pushed into the widened retention portion 52 through the entrance portion 50. Upon removal of the grasping force, the waistline portion 92 may decompress and conform to the shape of the widened retention portion 52, thus causing the pants 90 to be retained in the pants retaining notches 34.

While a preferred embodiment of the present invention(s) has been described, it should be understood that various changes, adaptations and modifications can be made therein without departing from the spirit of the invention(s) and the scope of the appended claims. The scope of the invention(s) should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

LIST OF REFERENCE CHARACTERS

10 dressing aid device.
20 shaft
22 distal end region
24 proximal end region
26 fastener
30 pants supporting head portion
32 arcuate surface
34 pants retaining notches
36 remote ends
38 clamping mechanism
40 connecting line
42 longitudinal side
44 longitudinal side
50 narrowing (tapered) entrance portion
52 retention portion
54 undercut
90 pants
92 waistline portion
94 waistline opening
96 belt loops
98 perimeter edge

What is claimed is:

1. A dressing aid device comprising:

a shaft having a longitudinal length;

a pants supporting head portion coupled to a distal end region of said shaft, wherein the pants supporting head portion is configured to operate with the shaft when the longitudinal length of the shaft is substantially horizontal to support pants along a waistline portion of the pants and provide an arcuate waistline opening to advance at least one leg of a user through the arcuate waistline opening; and wherein the pants supporting head portion includes at least one pants retaining notch configured to engage with the pants, wherein the at least one pants retaining notch is vertical when the longitudinal length of the shaft is horizontal, with an opening of the at least one pants retaining notch positioned vertically above a bottom of the at least one pants retaining notch.

2. The device of claim 1 wherein:

the pants supporting head portion is further configured to provide an arcuate waistline opening under a force of gravity.

3. The device of claim 1 wherein:

the arcuate waistline opening is substantially circular.

4. The device of claim 1 wherein:

the arcuate waistline opening is substantially vertical.

5. The device of claim 1 wherein:

the pants supporting head portion is configured to support pants along an arcuate surface of the pants supporting head portion.

6. The device of claim 5 wherein:

the arcuate surface is semi-circular.

7. The device of claim 5 wherein:

the arcuate surface is at least partially defined by a radius of at least 12 inches.

8. The device of claim 1 wherein:

the pants supporting head portion is configured to fit within belt loops of the pants.

9. The device of claim 1 wherein:

the pants supporting head portion is arch shaped.

10. The device of claim 1 wherein:

the pants supporting head portion is planar.

11. The device of claim 1 wherein:

the pants supporting head portion has a length of at least 7 inches.

12. The device of claim 1 wherein:

the at least one pants retaining notch further comprises a plurality of pants retaining notches to engage with the pants.

13. The device of claim 12 wherein:

the waistline portion of the pants comprises belt loops, and the plurality of pants retaining notches are configured to engage with the belt loops of the pants.

14. The device of claim 1 wherein:

the pants supporting head portion is arranged transverse to a longitudinal axis of the shaft.

15. The device of claim 1 wherein:

the pants supporting head portion is arranged substantially perpendicular to a longitudinal axis of the shaft.

16. The device of claim 1 wherein:

the pants supporting head portion is mechanically fastened to the shaft.

17. The device of claim 1 wherein:

the at least one pants retaining notch has a pants entrance portion and a pants retention portion; and the pants entrance portion is narrower than the pants retention portion.

18. The device of claim 17 wherein:

a lip is formed in the pants supporting head portion at a transition from the pants entrance portion to the pants retention portion.

19. The device of claim 18 wherein:

the pants entrance portion extends towards the pants retention portion with a taper.

20. The device of claim 19 wherein:

the pants entrance portion is V-shaped.

21. The device of claim 18 wherein:

an edge is formed in the pants supporting head portion at a transition from the pants entrance portion to the pants retention portion.

22. The device of claim 1 wherein:

the arcuate waistline opening is positioned beneath the shaft and the supporting head portion such that the at least one leg of the user is advanceable through the arcuate waistline opening beneath the shaft and the supporting head portion.

23. The device of claim 14 wherein:

the pants supporting head portion has a length of at least 7.25 inches transverse to the longitudinal axis of the shaft.

* * * * *